United States Patent [19]

Bowerman et al.

[11] 4,128,950

[45] Dec. 12, 1978

[54] MULTILAYERED SOLE ATHLETIC SHOE WITH IMPROVED FOAM MID-SOLE

[75] Inventors: William J. Bowerman; Stanley L. James; Dennis E. Vixie, all of Eugene, Oreg.

[73] Assignee: BRS, Inc., Beaverton, Oreg.

[21] Appl. No.: 766,530

[22] Filed: Feb. 7, 1977

[51] Int. Cl.[2] ..... A43B 13/12; A43B 13/18; A43B 13/28; A43B 23/28

[52] U.S. Cl. ..... 36/30 R; 36/59 C; 36/28; 36/44

[58] Field of Search ..... 36/30 R, 83, 114, 4, 36/32 R, 25 R, 43, 44, 104, 127, 59 R, 59 C, 9 R, 28

[56] References Cited

U.S. PATENT DOCUMENTS

| | | | |
|---|---|---|---|
| 2,410,019 | 10/1946 | Davis | 36/28 |
| 3,107,443 | 10/1963 | Binder et al. | 36/83 |
| 3,290,801 | 12/1966 | Bente | 36/127 |
| 3,724,105 | 4/1973 | Weight | 36/44 |
| 3,793,750 | 2/1974 | Bowerman | 36/59 C |

*Primary Examiner*—Patrick D. Lawson

*Attorney, Agent, or Firm*—Klarquist, Sparkman, Campbell, Leigh, Hall & Whinston

[57] ABSTRACT

An athletic shoe of reduced weight is described employing low density, closed cell, synthetic plastic foam for an intermediate sole layer and/or heel lift sole layer between a harder outer sole layer and the shoe upper. The foam is a polyethylene or ethylene vinyl acetate foam having a density not substantially less than 5 pounds per cubic foot, preferably at least 7 pounds per cubic foot. A lateral extending heel stabilizer plate of solid plastic material or a heel lift layer having a relatively hard outer border portion may be added to improve lateral stability.

24 Claims, 6 Drawing Figures

FIG. 1
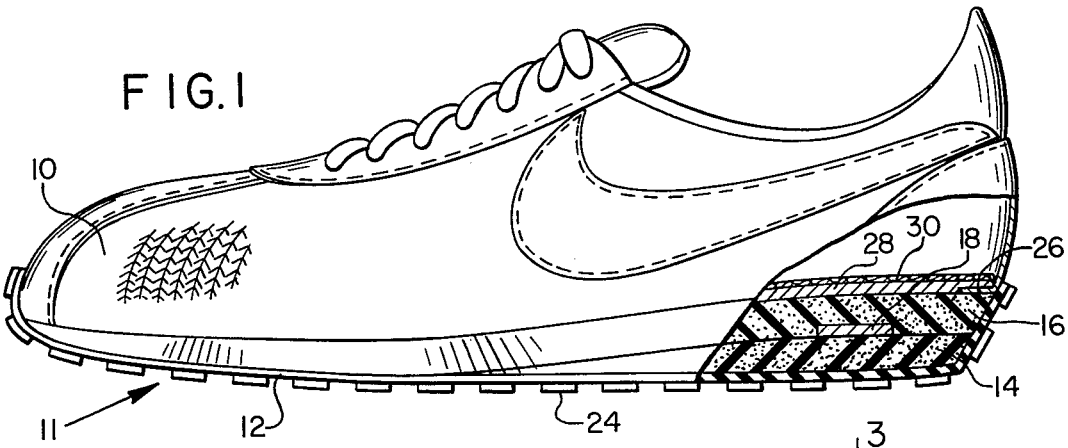
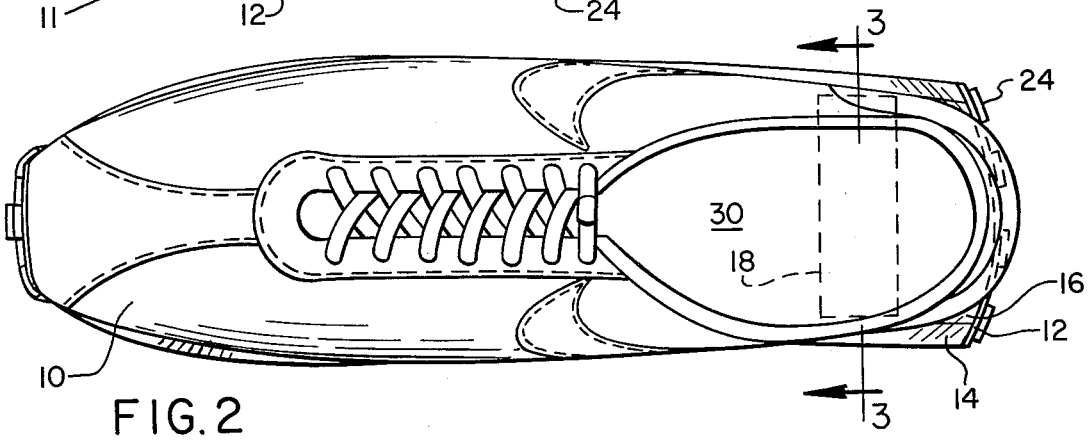
FIG. 2
FIG. 4
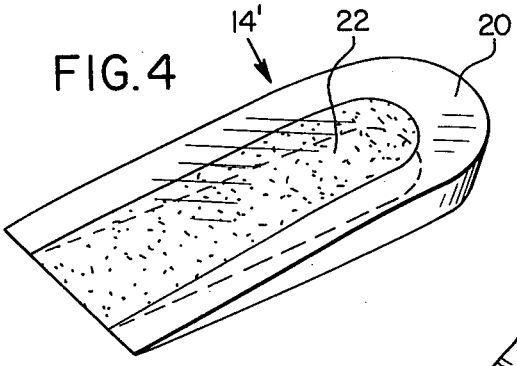
FIG. 5
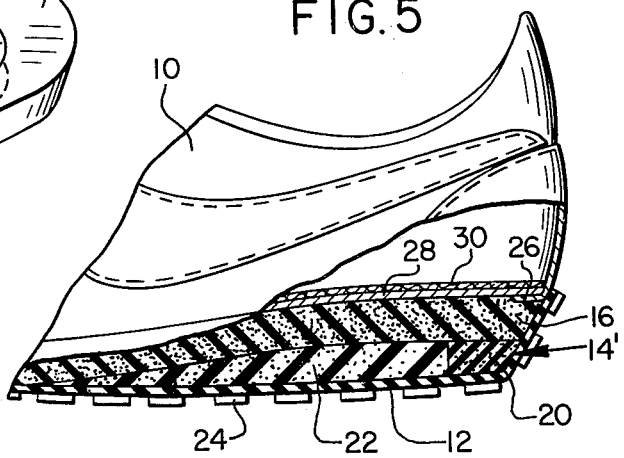
FIG. 3a
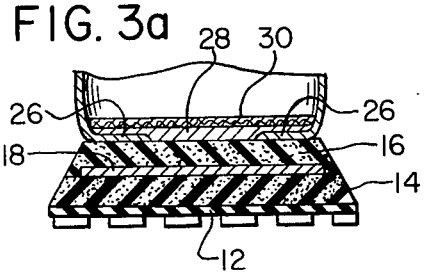
FIG. 3b
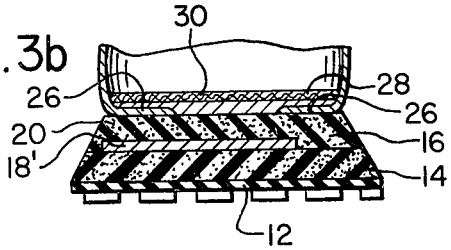

MULTILAYERED SOLE ATHLETIC SHOE WITH IMPROVED FOAM MID-SOLE

BACKGROUND OF THE INVENTION

The subject matter of the present invention relates generally to athletic shoes and in particular to multilayered sole athletic shoes of reduced weight having mid-sole layers of low density synthetic plastic foam material including an intermediate sole layer and a heel lift sole layer between a harder, wear-resistant outer sole layer and a shoe upper.

In athletic shoes and especially in track shoes used for competition, the weight of the shoe is a very important factor. In recent years, the use of fabrics made of nylon and other synthetic materials for shoe uppers has reduced the weight of athletic shoes but multilayered sole athletic shoes remained relatively heavy. U.S. Pat. No. 3,793,750 to Bowerman shows one such athletic shoe made with a nylon sandwich type fabric upper and cushioned midsole layer covered by a harder outer sole layer. While this shoe has a lightweight nylon upper, it employs conventional foam rubber for its mid-sole layers and therefore is not substantially lighter than other athletic shoes.

Previously U.S. Pat. No. 3,724,105 to Weight, disclosed that some non-athletic shoes have been made with foamed ethylene-vinyl acetate copolymer insoles within the shoe upper for greater comfort. However, such synthetic foam material has not heretofore been used in thicker mid-sole layers, which represent the major portion of the shoe weight, because it previously lacked sufficient durability and/or resilience and because it substantially reduces the lateral stability of the shoe.

U.S. Pat. No. 3,589,036 to Headricks shows a canvas upper tennis shoe which uses a non-foam, synthetic rubber material to replace vulcanized rubber in the shoe sole. The use of such synthetic rubbers has not appreciably reduced the weight of athletic shoes.

Some shoe designs leave apertures in various mid-sole layers and thereby incidentally reduce overall shoe weight to a small extent. For example, U.S. Pat. No. 3,290,081 to Bente has proposed that spiked track shoes used for jumping include an empty aperture in the heel lift sole layer to reduce heel injury. Such shoes are not substantially lighter than standard athletic shoes and lack sufficient heal cushioning for running shoes.

SUMMARY OF THE INVENTION

The present invention is a lightweight multilayered sole athletic shoe including intermediate sole and/or heel lift layers made of polyethylene or ethylene vinyl acetate foam. Sole layers made of this material are flexible, shock absorbing, resilient and durable, but substantially less dense than comparable layers of crepe rubber or other standard athletic shoe sole material. Reductions in lateral stability of the shoe which may result from the use of these lightweight synthetic foam materials, are obviated by providing heel stabilizer constructions in the form of a lateral plate of solid plastic or a heel lift border of harder foam.

It is therefore one object of the present invention to provide an improved multilayered sole athletic shoe having intermediate sole layers of low density plastic foam which are extremely lightweight but which provide adequate cushioning, comfort and support.

Another object of the invention is to provide such a shoe having good lateral stability.

Another object of the invention is to provide such a shoe in which the heel lift layer and intermediate sole layer are covered by an outer sole layer of harder resilient wear-resistant material which may have polygon-shaped cleats molded in its outer bottom surface.

Other objects and advantages of the present invention will be apparent from the following detailed description of certain preferred embodiments thereof and from the attached drawing.

BRIEF DESCRIPTION OF THE DRAWINGS

In the drawings:

FIG. 1 is a partially cut away side elevation view of an athletic shoe in accordance with the preferred embodiment of the present invention;

FIG. 2 is a top elevation view of the shoe of FIG. 1;

FIG. 3*a* is a sectional view taken along lines 3—3 of FIG. 2;

FIG. 3*b* is a sectional view taken along lines 3—3 of FIG. 2 showing a modification of the heel stabilizing plate in the shoe of FIGS. 1 and 2;

FIG. 4 is a partially cut away side elevation view of the heel portion of an athletic shoe in accordance with an alternative embodiment of the present invention; and FIG. 5 is a perspective view of a tapered heel lift sole layer in the shoe of FIG. 4.

DESCRIPTION OF THE PREFERRED EMBODIMENTS

As shown in FIG. 1, one embodiment of the athletic shoe of the present invention includes a shoe upper 10 of leather or synthetic plastic fabric, such as the nylon sandwich layer of U.S. Pat. No. 3,793,750, secured to a multilayered sole 11. The sole 11 includes an outer sole layer 12 of hard resilient wear-resistant rubber material, a heel lift sole layer 14 of resilient lightweight synthetic plastic foam cushioning material and an intermediate sole layer 16 of similar plastic foam material. The heel lift sole layer 14 extends longitudinally beneath the wearer's heel bone and arch and is approximately of the same maximum thickness of about ¼-inch as the intermediate sole layer in the heel area. Such heel lift sole layer tapers to a smaller thickness under the arch until it terminates at the instep slightly behind the metatarsal bones, while the intermediate layer extends the full length of the foot. The heel lift sole layer 14 is preferably positioned between the intermediate sole layer 16 and the outer sole layer 12, but the positions of the heel lift sole layer 14 and intermediate sole layer 16 may be reversed.

The heel lift layer 14 and intermediate sole layer 16 are made of low density, resilient, closed cell synthetic plastic foam material of polyethylene or polyethylene vinyl acetate such as that made by the methods of U.S. Pat. No. 3,657,165 of Kawai et al granted Apr. 12, 1972 and U.S. Pat. No. 3,711,584 of Sagane et al granted Jan. 16, 1963. These plastic foams are used in place of prior art sole layers made from high density foams of natural or synthetic rubbers, such as neoprene, butadiene-styrene copolymer, alkylene polysulfide, etc. For sufficient resiliency and durability the synthetic plastic foam material used in these layers should have a minimum density not substantially less than about five pounds per cubic foot and preferably of at least seven pounds per cubic foot. For sufficient flexibility and compression as well as low weight, the foam should have a maximum density not substantially greater than about 30 pounds per cubic foot. Closed cell foams are used because they do not absorb water.

One suitable foam material is an electron radiation cross-linked polyethylene foam sold under the tradename Volara, Type A, manufactured by Voltek, Inc., of Lawrence, Massachusetts. Laminated sheets of this polyethylene foam having a density of 7.0 pounds per cubic foot at 76° F. and a hardness of 35 to 37 durometer, A-type, at 68° F. as well as sheets having a density of 5.8 pounds per cubic foot at 76° F. and a hardness of 28 to 30 durometer, A-type, at 68° F. are both suitable. Another suitable material is an ethylene vinyl acetate copolymer having a density of 8.3 pounds per cubic foot at 76° F. and a hardness of 26 to 29 durometer, A-type, at 68° F.

These and other closed cell foam materials were tested to determine physical characteristics of synthetic foams which were proven in use tests to be suitable for athletic shoe sole layers. The results of the tests are summarized in Table I.

TABLE I

| Sample identification | A | B | C | D | E |
|---|---|---|---|---|---|
| Composition | Polyethylene | Polyethylene | Polyethylene | Polyethylene vinyl acetate | Crepe rubber |
| Density (lb/ft$^3$) 76° F. (ASTM D1565) | 2.4 | 5.8 | 7.0 | 8.3 | 42 |
| Hardness, A-type, Durometer, 68° F. (ASTM D2240) | 11–15 | 28–30 | 35–37 | 26–29 | 44–46 |
| Tensile strength (psi) Type IV Test bar, one inch gage length, 68° F. (ASTM D638) | 60* | 112* | 178* | 170* | 1470** |
| Compression Set. (percent) 65–69° F. at stated intervals after pressure release. (ASTM D1565) | | | | | |
| 1 hour | 29.4 | 13.3 | 16.7 | 17.0 | 4.4 |
| 2 hours | 26.2 | 12.0 | 14.2 | 14.1 | 3.4 |
| 24 hours | 4.4 | 0.8 | 0.8 | 5.2 | 2.0 |

*Dead weight loading
**Two inch minimum loading rate.

Referring to Table I, sample A is a polyethylene material which proved to be not sufficiently hard, resilient or durable for use in athletic shoe soles. The test results show this material to have the lowest hardness and tensile strength of the materials tested and the highest compression set after short time intervals. The other polyethylene-containing materials (samples B, C and D) performed satisfactorily during field tests. Of the suitable materials, sample B material is least favored due to its relatively low hardness and resiliency. The materials of sample C and D are similar to each other in performance, but the sample C material is most preferred due to its greater hardness and its lower compression set after 94 hours. Sample E material, a standard crepe rubber currently used in athletic shoe sole layers and having a high density of 42 pounds per cubic foot, was tested for the purpose of comparison.

The test results show that the polyethylene of sample C and the ethylene vinyl acetate of sample D each have a hardness and lack of compression set which approach those characteristics of sample E crepe rubber material, but that the synthetic materials were less than a fifth as dense as the tested crepe. Due to this extreme difference in density, shoes having synthetic foam sole layers are substantially lighter than crepe soled shoes. As a practical example, a woman's size nine athletic shoe, with both the heel lift and intermediate sole layers made of sample C material, will weigh as little as 4.5 ounces. The crepe has a significantly higher tensile strength than either of synthetic plastic foams but this higher material strength is not essential for satisfactory athletic shoe sole layers.

Although very lightweight, the high compliancy of some synthetic plastic foams might allow the wearer's foot to twist when it strikes the ground. Where such materials are used it is advisable that a stabilizer means be included in the sole construction to increase lateral stability of the shoe. One suitable stabilizer means, shown in FIGS. 1, 2 and 3, is a thin rectangular stabilizer plate 18 located between the intermediate sole layer 16 and the heel lift layer 14 and extending laterally across the heel. This stabilizer plate is about 1/16 inch thick and is made of a semirigid, solid synthetic plastic material such as nylon, polyethylene or polypropylene.

FIG. 3*a* shows a stabilizer plate 18 which extends substantially across the entire width of the sole layer. A second embodiment, shown in FIG. 3*b*, includes a shortened stabilizer plate 18 extending laterally from a position adjacent the outside of the wearer's heel bone to a position adjacent the inner edge 20 of the intermediate sole layer. This latter embodiment provides lateral stability on the inside of the sole but allows some flexibility on the outside.

FIGS. 4 and 5 illustrate an alternative stabilizer means for use when both the intermediate and heel lift sole layers incorporate low density synthetic foam. This construction includes a heel lift layer 14' having an outer border portion 20 which surrounds an inner core 20 of a lightweight, low density synthetic plastic foam material. The foam core 22 is located within a single elongated opening passing through the outer border portion 20 and extends longitudinally beneath the heel of the foot for cushioning. The border portion 20 is made of harder higher density material than the core 22 to provide the heel lift layer with greater lateral stability and thereby to prevent sprained ankles and other injuries to the foot. This harder material is preferably a relatively dense, resilient closed cell foam material. One suitable material for the border portion 20 would be the 42 pound per cubic foot density crepe rubber referred to as sample E in Table I.

As shown in FIGS. 1 and 5, the outer sole layer 12 includes a plurality of straight sided polygon-shaped cleats 24 extending downwardly from the lower surface of the outer sole layer and formed of hard rubber molded integrally therewith, such as the square cleats shown in U.S. Pat. No. 3,793,750 referred to previously. These cleats provide the shoe with good traction and additional cushioning. Of course, the outer sole is made of a harder, more wear-resistant rubber or other resilient material, than are the cushioning layers 14 and 16. This outer sole of about ⅛-inch thickness is thinner and harder than the cushioning layers 14 and 16 and can be replaced when it wears out.

The outer sole layer, the heel lift layer and the intermediate sole layer are bonded together in a conventional manner by waterproof glue such as rubber contact cement, or by another suitable bonding agent. The bonding agent may be selected to stiffen soles made from highly flexible low density synthetic plastic foam materials. However, for higher density foams especially in the 20 to 30 pounds per cubic foot range it is preferable to bond these layers together thermally without the use of glue, because soles made of such high density foams are sufficiently stiff without the added stiffness provided by such glue. In addition, a peripheral boundary portion of the upper surface of the intermediate sole layer 16 is bonded to the inner edges 26 of the shoe upper, as shown in FIGS. 1, 3 and 5. An inner platform layer 28 of any suitable material, such as fiberboard or cardboard, is provided within the shoe, is similarly bonded over the edges 26 of the upper, and is also bonded over the intermediate sole layer 16. A resilient foam insole layer 30, such as closed cell foam rubber, having a fabric bonded to its upper surface, is provided within the shoe over this platform layer to prevent blisters on the foot.

While we have shown and described several preferred embodiments of our invention, it will be apparent to those skilled in the art that changes and modifications may be made without departing from our invention in its broader scope.

We claim:

1. An athletic shoe comprising:
a shoe upper;
an outer sole;
an intermediate sole layer provided between said outer sole and said upper, said intermediate sole layer being of greater thickness than said outer sole for resilient cushioning during running and comprising a closed cell synthetic plastic foam material having a density not substantially less than 5 pounds per cubic foot; and
a heel lift sole layer provided between said outer sole and said upper and positioned beneath the heel of a wearer's foot, said heel lift sole layer being of greater thickness than said outer sole for resilient cushioning during running and comprising a closed cell synthetic plastic foam material having a density not substantially less than 5 pounds per cubic foot.

2. An athletic shoe in accordance with claim 1 wherein said heel lift sole layer is comprised of closed cell plastic foam which is made of a cross-linked polymer selected from the group consisting of polyethylene and copolymers of ethylene and vinyl acetate.

3. An athletic shoe in accordance with claim 2 in which the foam of said heel lift has a density of at least seven pounds per cubic foot.

4. An athletic comprising:
a shoe upper;
an outer sole;
an intermediate sole layer provided between said outer sole and said upper, said intermediate sole layer being of greater thickness than said outer sole for resilient cushioning during running and comprising a closed cell synthetic plastic foam material having a density not substantially less than 5 pounds per cubic foot; and
a tapered heel lift sole layer provided between said outer sole and said upper and positioned beneath the heel of a wearer's foot, said heel lift sole layer comprising a border portion of resilient material surrounding an inner core portion of softer and less dense resilient foam material provided for cushioning within an opening through said heel lift sole layer and extending longitudinally of the shoe so that said core portion is positioned beneath the heel bone of the wearer's foot, said border portion being sufficiently wide and noncompressible to enhance the laterial stability of said shoe and correct any tendency for instability due to the use of said closed cell synthetic plastic foam material in said intermediate sole layer.

5. An athletic shoe in accordance with claim 4 wherein said border portion of said heel lift sole layer is made of crepe rubber foam.

6. An athletic shoe comprising:
a shoe upper;
an outer sole;
an intermediate sole layer provided between said outer sole and said upper, said intermediate sole layer comprising a closed cell synthetic plastic foam material having a density not substantially less than 5 pounds per cubic foot; and
a tapered heel lift sole layer provided between said outer sole and said upper and positioned beneath the heel of a wearer's foot, said heel lift sole layer comprising a border portion of resilient material surrounding an inner core portion of softer and less dense resilient foam material provided within an opening through said heel lift sole layer and extending longitudinally of the shoe so that said core portion is positioned beneath the heel bone of the wearer's foot, said inner core portion of said heel lift sole layer being made of closed cell synthetic plastic foam material selected from the group consisting of polyethylene and copolymers of ethylene and vinyl acetate.

7. An athletic shoe comprising:
a shoe upper;
an outer sole;
an intermediate sole layer provided between said outer sole and said upper, said intermediate sole layer comprising a closed cell synthetic plastic foam material having a density not substantially less then five pounds per cubic foot; and
a simirigid stabilizer plate of synthetic plastic extending laterally across said intermediate sole layer and positioned beneath the heel bone of the wearer's foot.

8. An athletic shoe in accordance with claim 7 wherein said stabilizer plate extends laterally from a position beneath the outside of the wearer's heel bone to a position adjacent the inner edge of said intermediate sole layer.

9. An athletic shoe in accordance with claim 7 wherein said stabilizer plate is made of a solid, synthetic plastic material selected from the group consisting of nylon, polyethylene and polypropylene.

10. An athletic shoe comprising:

a shoe upper;

an outer sole;

an intermediate sole layer provided between said outer sole and said upper, said intermediate sole layer being of greater thickness than said outer sole for resilient cushioning during running and comprising a closed cell foam of cross-linked polyethylene; and a heel lift sole layer of closed cell synthetic plastic foam provided between said outer sole and said upper and positioned beneath the heel of a wearer's foot, said heel lift sole layer being of greater thickness than said outer sole for resilient cushioning during running.

11. An athletic shoe in accordance with claim 10 wherein said heel lift sole layer comprises a closed cell foam of cross-linked polyethylene.

12. An athletic shoe in accordance with claim 10 wherein said heel lift sole layer and said intermediate sole layer both have a density not substantially less than 5 pounds per cubic foot.

13. An athletic shoe in accordance with claim 12 wherein said intermediate sole layer and said heel lift sole layer both have a density of at least seven pounds per cubic foot.

14. An athletic shoe comprising:

a shoe upper;

an outer sole;

an intermediate sole layer provided between said outer sole and said upper, said intermediate sole layer being of greater thickness than said outer sole for resilient cushioning during running and comprising a closed cell foam of cross-linked polyethylene; and a tapered heel lift sole layer which comprises a border portion of resilient material surrounding an inner core portion of softer and less dense resilient foam material provided for cushioning within an opening through said heel lift sole layer and extending longitudinally of the shoe so that said core portion is positioned beneath the heel bone of the wearer's foot, said border portion being sufficently wide and noncompressible to enhance the laterial stability of said shoe and correct any tendency for instability due to the use of said closed cell foam of cross-linked polyethylene in said intermediate sole layer.

15. An athletic shoe in accordance with claim 14 wherein said border portion of said heel lift sole layer is made of crepe rubber foam.

16. An atheltic shoe comprising:

a shoe upper;

an outer sole;

an intermediate sole layer provided between said outer sole and said upper, said intermediate sole layer comprising a closed cell foam of cross-linked polyethylene; and a tapared heel lift sole layer provided between said outer sole and said upper and positioned beneath the heel of a wearer's foot, said heel lift sole layer comprising a border portion of resilient material surrounding an inner core portion of softer and less dense resilient foam material provided within an opening through said heel lift sole layer and extending longitudinally of the shoe so that said core portion is positioned beneath the heel bone of the wearer's foot, said inner core portion of said heel lift sole layer being made of closed cell synthetic plastic foam material selected from the group of cross-linked polymers consisting of polyethylene and copolymers of ethylene and vinyl acetate.

17. An athletic shoe comprising:

a shoe upper;

an outer sole;

an intermediate sole layer provided between said outer sole and said upper, said intermediate sole layer comprising a closed cell foam of cross-linked polyethylene;

a tapered heel lift sole layer provided between said outer sole and said upper and positioned beneath the heel of a wearer's foot, said heel lift sole layer comprising a border portion of resilient material surrounding an inner core portion of softer and less dense resilient foam material provided within an opening through said heel lift sole layer and extending longitudinally of the shoe so that said core portion is positioned beneath the heel bone of the wearer's foot; and a semirigid stabilizer plate of synthetic plastic extending laterally across the intermediate sole layer and positioned beneath the heel bone of the wearer's foot.

18. An athletic shoe in accordance with claim 17 wherein said stabilizer plate extends laterally from a position beneath the outside of the wearer's heel bone to a position adjacent the inner edge of said sole intermediate layer.

19. An athletic shoe in accordance with claim 17 wherein said stabilizer plate is made of a solid, synthetic plastic material selected from the group consisting of nylon, polyethylene and polypropylene.

20. In an athletic shoe having a shoe upper, a flexible outer sole layer and a flexible, cushioning intermediate sole layer between said outer sole and said upper, the improvement comprising a semirigid stabilizer plate of synthetic plastic extending transversely to the longitudinal axis of said intermediate sole layer across substantially the entire width of said layer and positioned beneath the heel bone of the wearer's foot to enhance the lateral stability of said intermediate solelayer.

21. The improvement of claim 20 wherein said stabilizer plate is positioned between the intermediate sole layer and a heel lift sole layer provided beneath the heel and between the outer sole and the shoe upper.

22. The improvement of claim 20 wherein said stabilizer plate extends laterally from a position beneath the outside of the wearer's heel bone to a position adjacent the inner edge of said intermediate sole layer.

23. The improvement of claim 20 wherein said stabilizer plate is made of a solid, synthetic plastic material selected from the group consisting of nylon, polyethylene and polypropylene.

24. An athletic shoe comprising:

a shoe upper;

an outer sole;

an intermediate sole layer provided between said outer sole and said upper, said intermediate sole layer being of greater thickness than said outer sole for resilient cushioning during running and comprising a closed cell synthetic plastic foam material having a density not substantially less than five pounds per cubic foot or greater than about 9 pounds per cubic foot; and stabilizer means associated with said intermediate sole layer upper at a location beneath the heel of the wearer's foot to enhance the lateral stability of said intermediate sole layer.

* * * * *